US009162847B2

(12) United States Patent
Gupta

(10) Patent No.: US 9,162,847 B2
(45) Date of Patent: Oct. 20, 2015

(54) WIRE DISPENSER FOR BEADING

(71) Applicant: Nikhil Gupta, Schaumburg, IL (US)

(72) Inventor: Nikhil Gupta, Schaumburg, IL (US)

(73) Assignee: DPG USA INC., Schaumburg, IL (US)

( * ) Notice: Subject to any disclaimer, the term of this patent is extended or adjusted under 35 U.S.C. 154(b) by 88 days.

(21) Appl. No.: 13/675,074

(22) Filed: Nov. 13, 2012

(65) Prior Publication Data

US 2013/0140396 A1 Jun. 6, 2013

Related U.S. Application Data

(60) Provisional application No. 61/629,995, filed on Dec. 2, 2011.

(51) Int. Cl.

| | |
|---|---|
| ***B65D 85/02*** | (2006.01) |
| ***B65D 85/67*** | (2006.01) |
| ***B65H 75/30*** | (2006.01) |
| ***B65H 49/20*** | (2006.01) |
| ***B65H 59/06*** | (2006.01) |

(52) U.S. Cl.

CPC ..... *B65H 75/30* (2013.01); *B65H 49/205* (2013.01); *B65H 59/06* (2013.01); *B65H 2701/36* (2013.01)

(58) Field of Classification Search

USPC ..... 242/170, 171, 172, 566, 579, 580, 586, 242/588, 588.3, 588.6

See application file for complete search history.

(56) References Cited

U.S. PATENT DOCUMENTS

| | | | | |
|---|---|---|---|---|
| 4,938,760 | A * | 7/1990 | Burton et al. | 600/29 |
| 6,547,725 | B1 * | 4/2003 | Paolitto et al. | 600/201 |
| 2003/0025023 | A1 * | 2/2003 | Rosenfeld | 242/395 |
| 2005/0166636 | A1 * | 8/2005 | Lazor | 63/38 |

* cited by examiner

*Primary Examiner* — Emmanuel M Marcelo
*Assistant Examiner* — Angela Caligiuri
(74) *Attorney, Agent, or Firm* — Robert S. Alexander

(57) ABSTRACT

Wire used for beading is coiled on a rotably mounted reel in a dispenser having a reel brake bearing against the reel with the wire passing through a channel as extended to the exterior of the dispenser with the wire frictionally engaging both the walls of the channel and a resilient element pressing against the wire to modulate the force required to withdraw the wire from the dispenser to a value which is high enough to prevent spontaneous unwinding of the wire from around the reel but still allowing easy removal from the dispenser when desired.

19 Claims, 18 Drawing Sheets

Fig. 16A
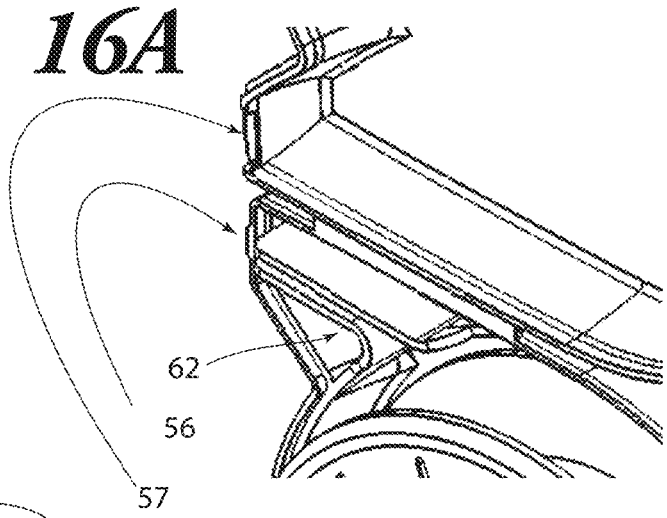
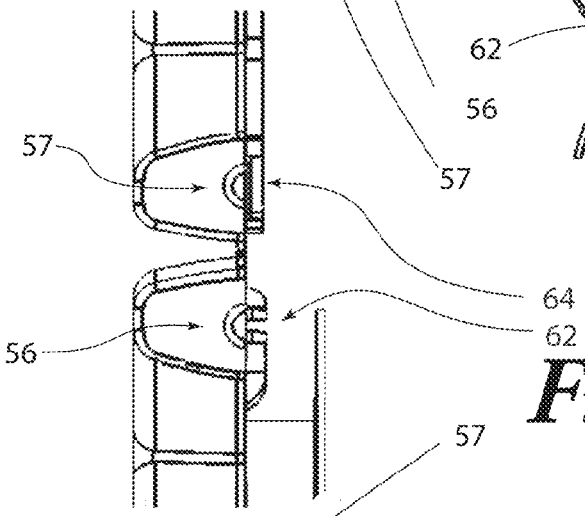
Fig. 16B
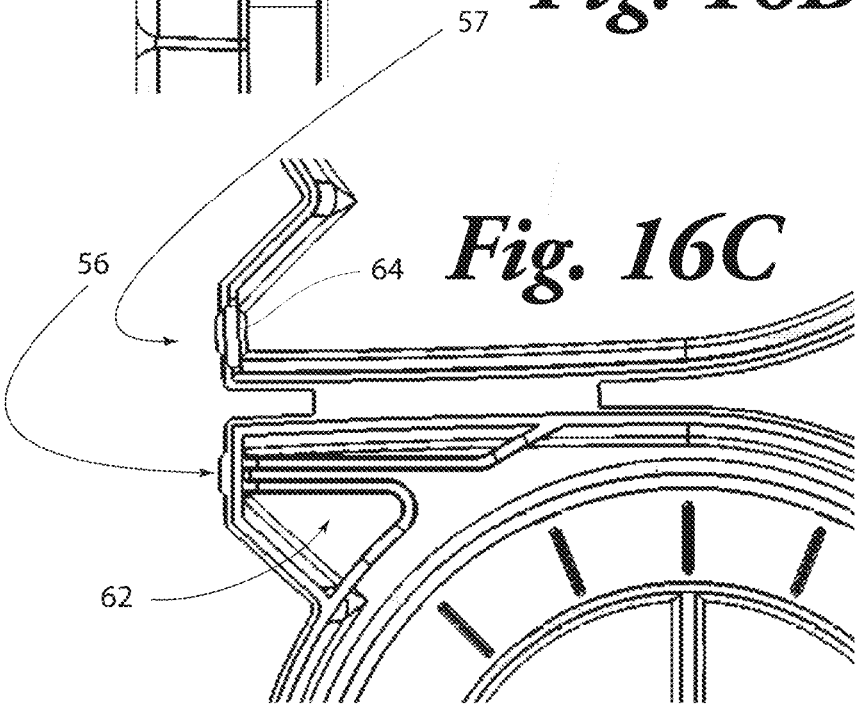
Fig. 16C

WIRE DISPENSER FOR BEADING

CLAIM FOR PRIORITY

This non-provisional application claims the benefit of the filing date of U.S. Provisional Patent Application Ser. No. 61/629,995, of the same title, filed Dec. 2, 2011. The priority of U.S. Provisional Patent Application Ser. No. 61/629,995 is hereby claimed and the disclosure thereof is incorporated into this application by reference.

Many hobbyists have taken up beading as a past time, making decorative jewelry and ornamental objects for their families and friends as well as themselves. Many beaded items are formed by placing beads on a wire or other filament to make necklaces, bracelets, key rings, bangles and other decorative items. Because many beaders like to practice their hobby in odd moments of spare time as they go about their daily life, transportability and convenience are important in the accessories that they use. One issue involves beading wire which is often sold on a spool which, due to its inherent stiffness, allows the wire to spontaneously unspool when carried about in a purse or beading, often putting crimps in the wire making it either unattractive for many of the beaded projects or difficult to use or too often spoiling it completely for beading applications. Beading wire is of a rather specialized construction, normally comprising a multiplicity of strands, most often, 7, 19, 21 or 49, so that it will drape properly once the beads are strung upon it. Because this drapability makes it quite easy for beading wire to come spontaneously off of a reel or unspool, a rather specialized dispenser is required.

This invention relates to a dispenser for beading wire or other beading filaments which may be transported easily and conveniently which does not allow the wire to unspool spontaneously but makes it easy for the beader to withdraw the desired amount while ensuring that the beading wire even though protected does not retract into the dispenser overly easily as well as ensuring that, if by happenstance it is urged inwardly into the dispenser, the beader will have little difficulty restarting it as the dispenser is easily openable.

BRIEF DESCRIPTION OF THE DRAWINGS

The invention is described in detail below with reference to the various Figures, wherein:

FIG. 16A is an isometric perspective detail of the throat of a dispenser of the present invention in the open conformation; whilst FIG. 16B is an end-on detail view of the throat illustrated in FIG. 16A and FIG. 16C is a plan view of the throat detail of a dispenser of the present invention in the open conformation;

DESCRIPTION OF THE PREFERRED EMBODIMENT

Figure 1:
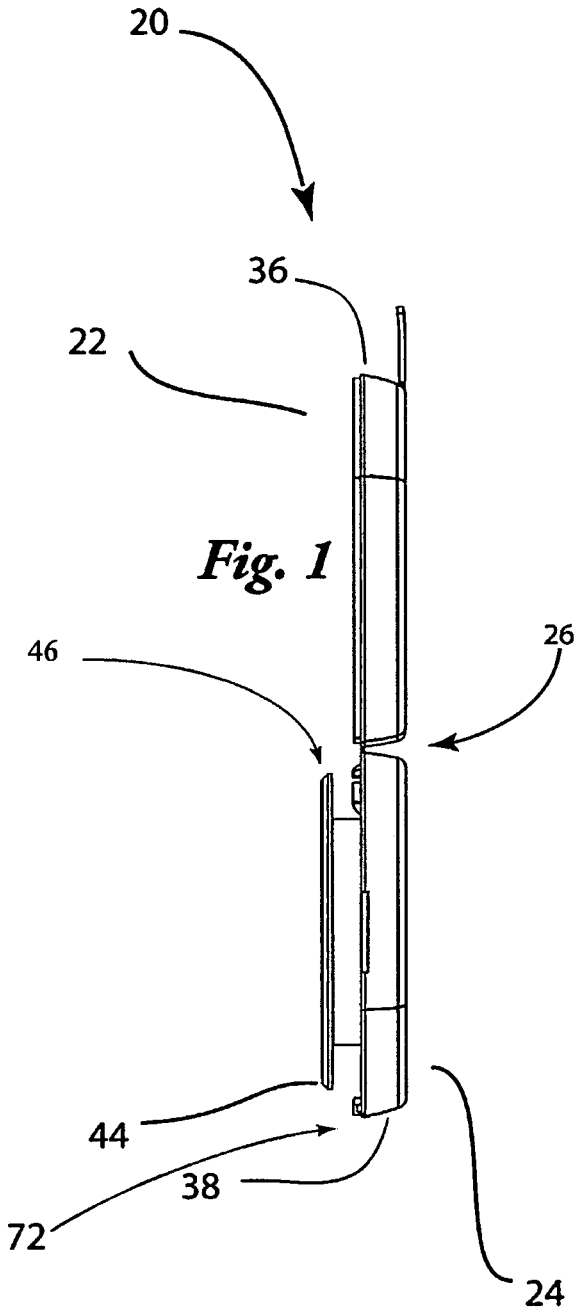
FIG. 1 is a left elevation of a dispenser of the present invention.
Figure 2:
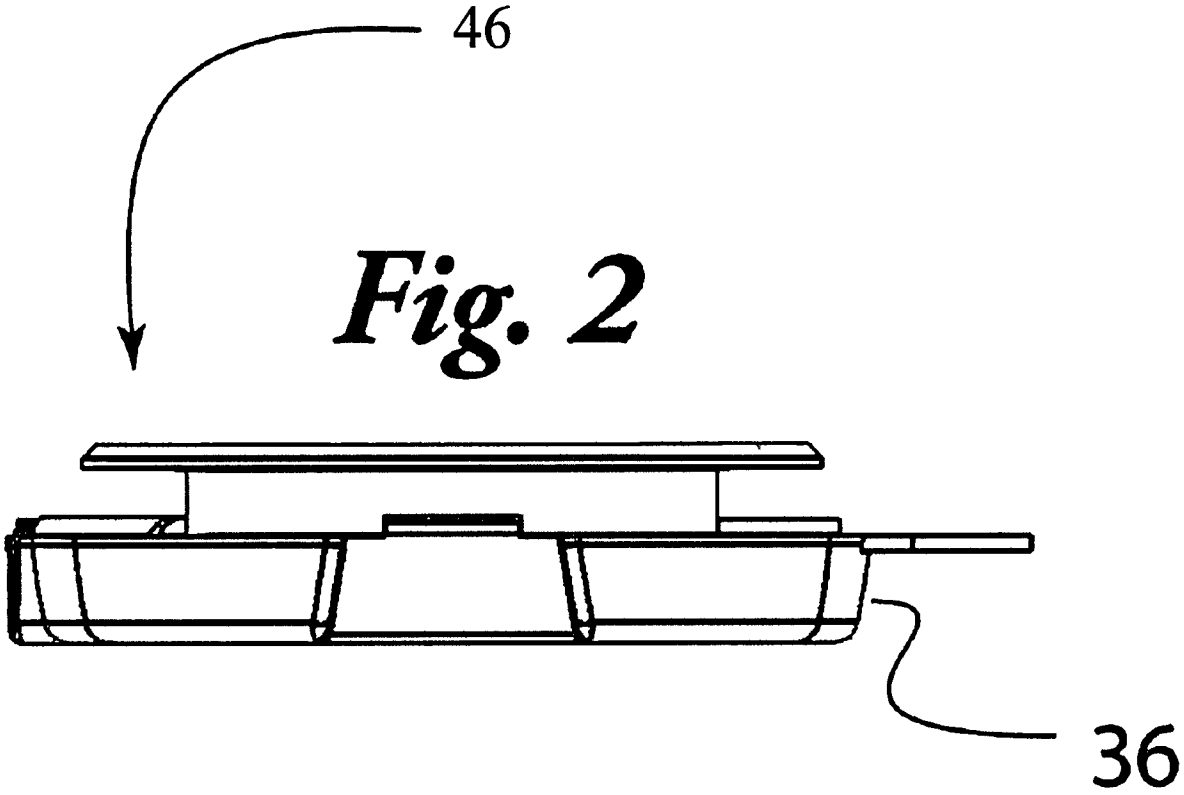
FIG. 2 is a top view of that dispenser whilst in an opened conformation.
Figure 3:
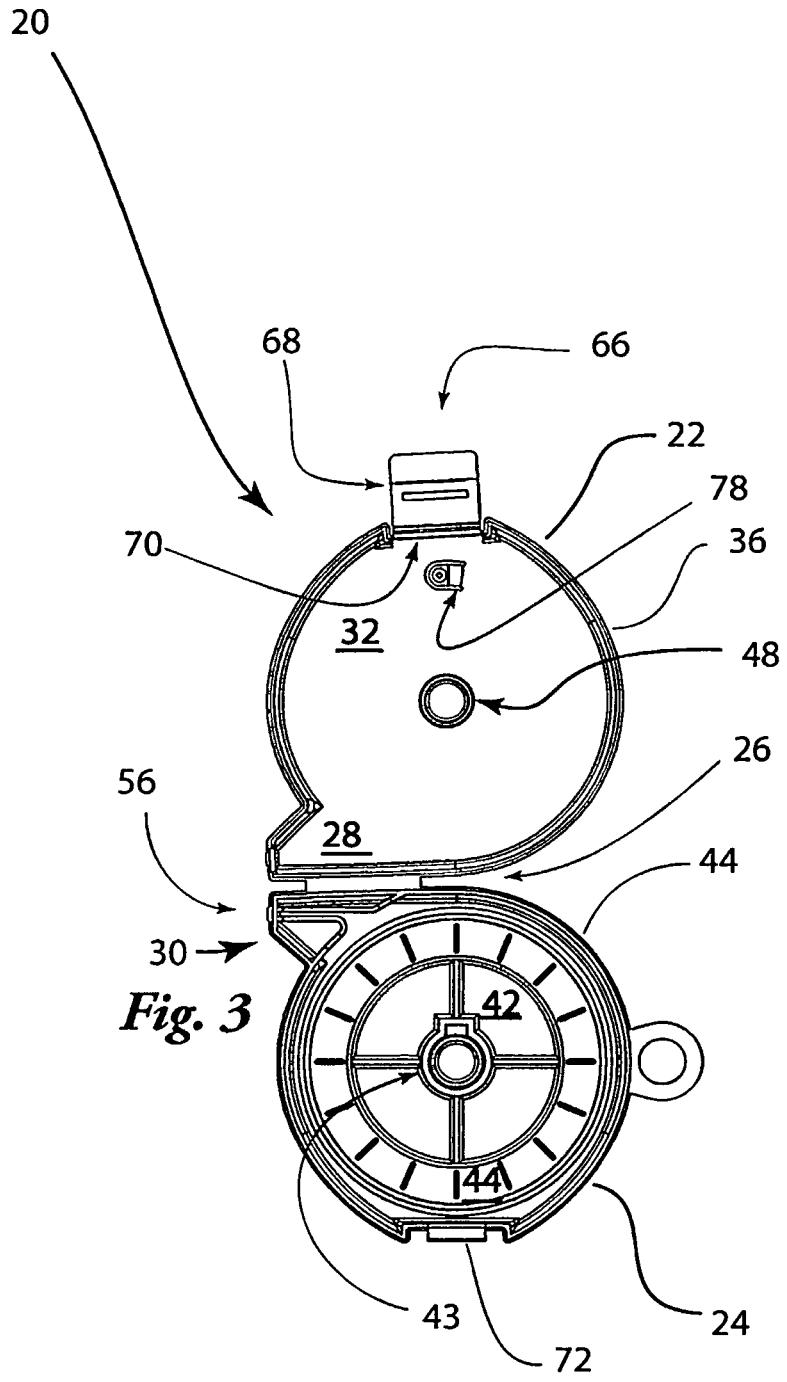
FIG. 3 is a plan view of the interior of that dispenser in an opened conformation.
Figure 4:
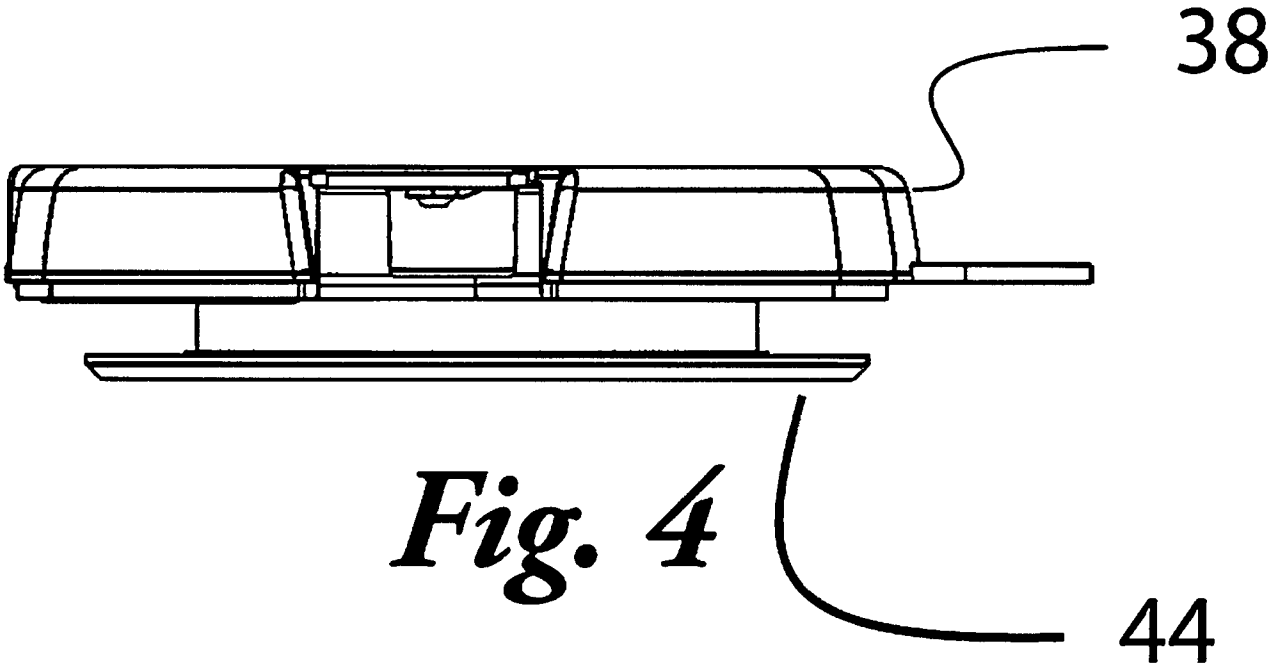
FIG. 4 is bottom view of that dispenser whilst in an opened conformation.
Figure 5:
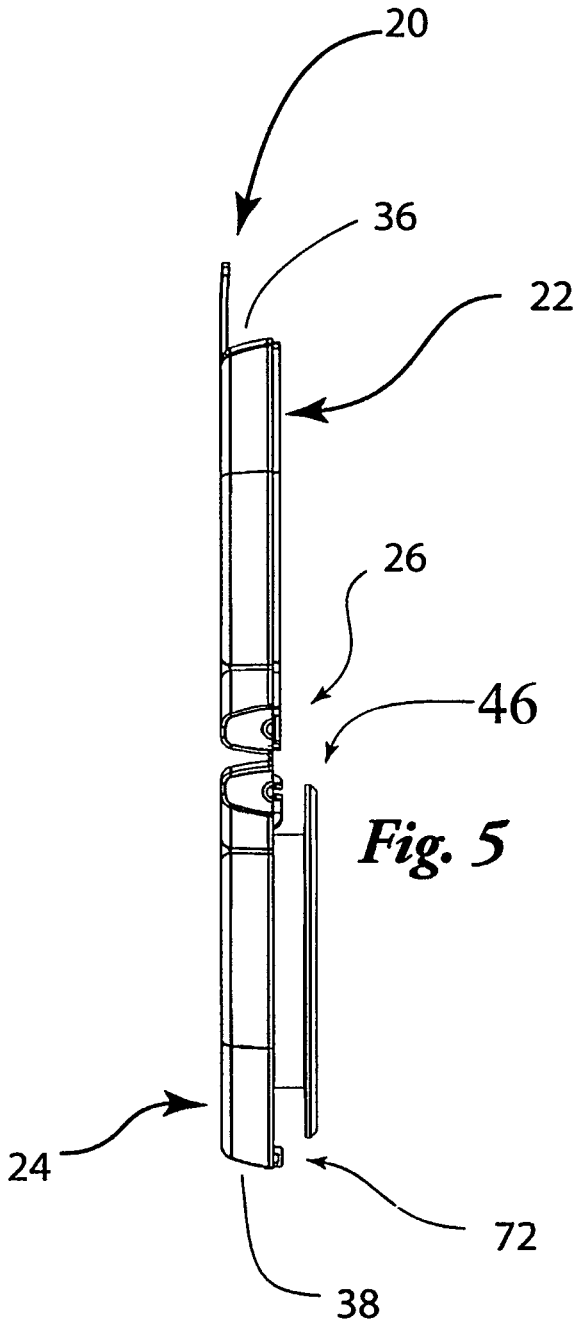
FIG. 5 is a right elevation.
Figure 6:
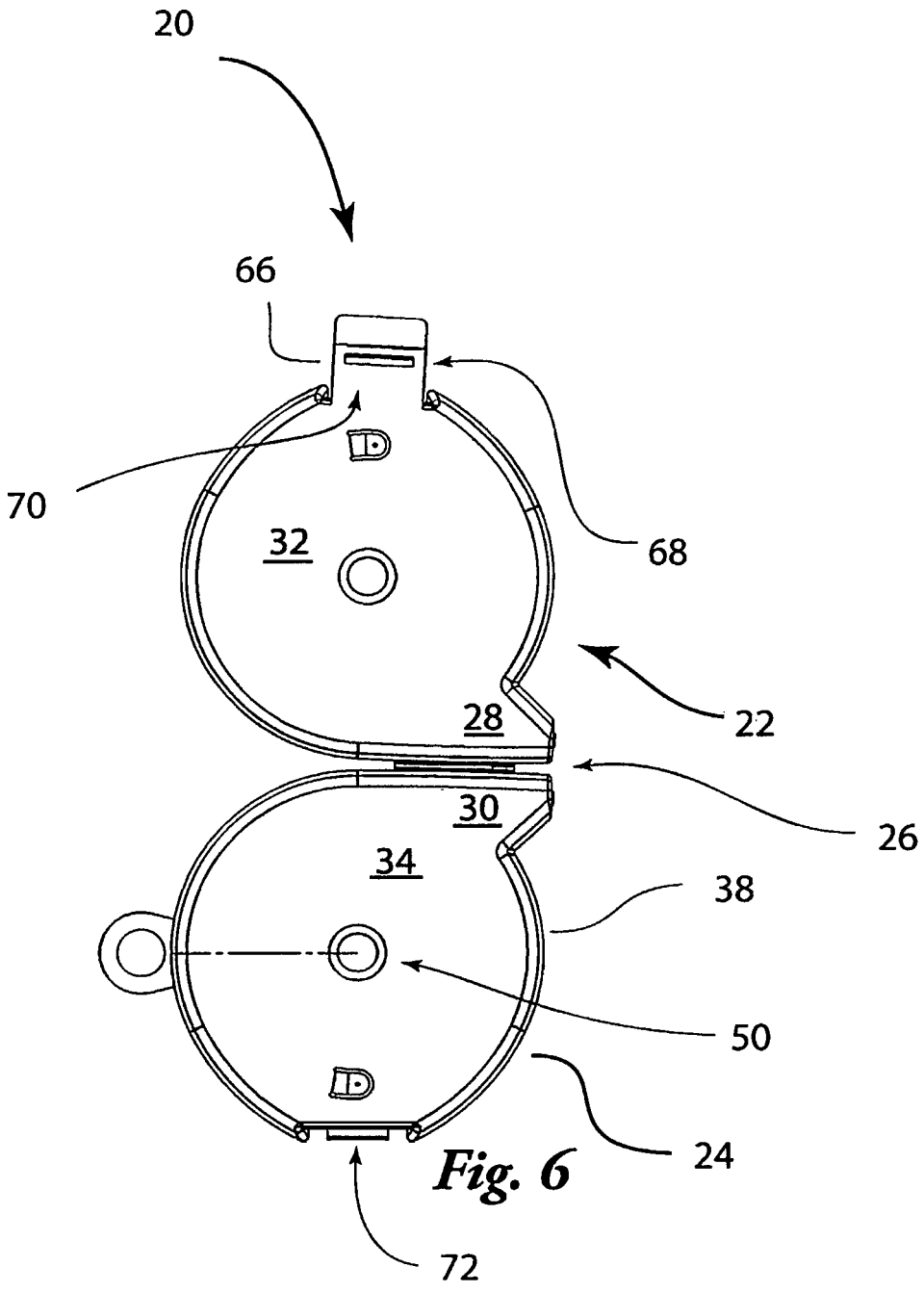
FIG. 6 is a plan view of the exterior of that dispenser in an opened conformation.
Figure 7:
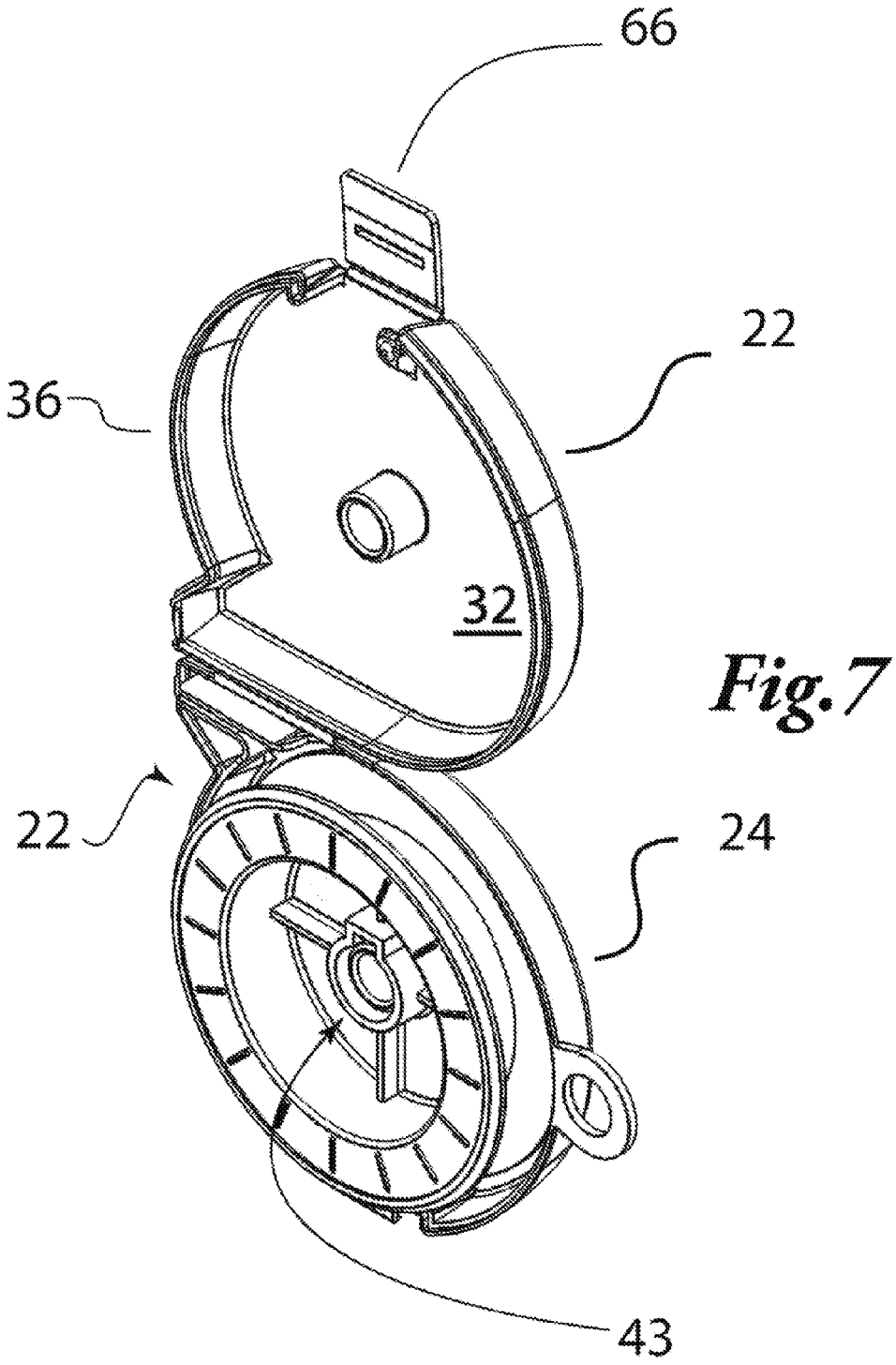
FIG. 7 is isometric perspective of the interior of that dispenser in an opened conformation.
Figure 8:
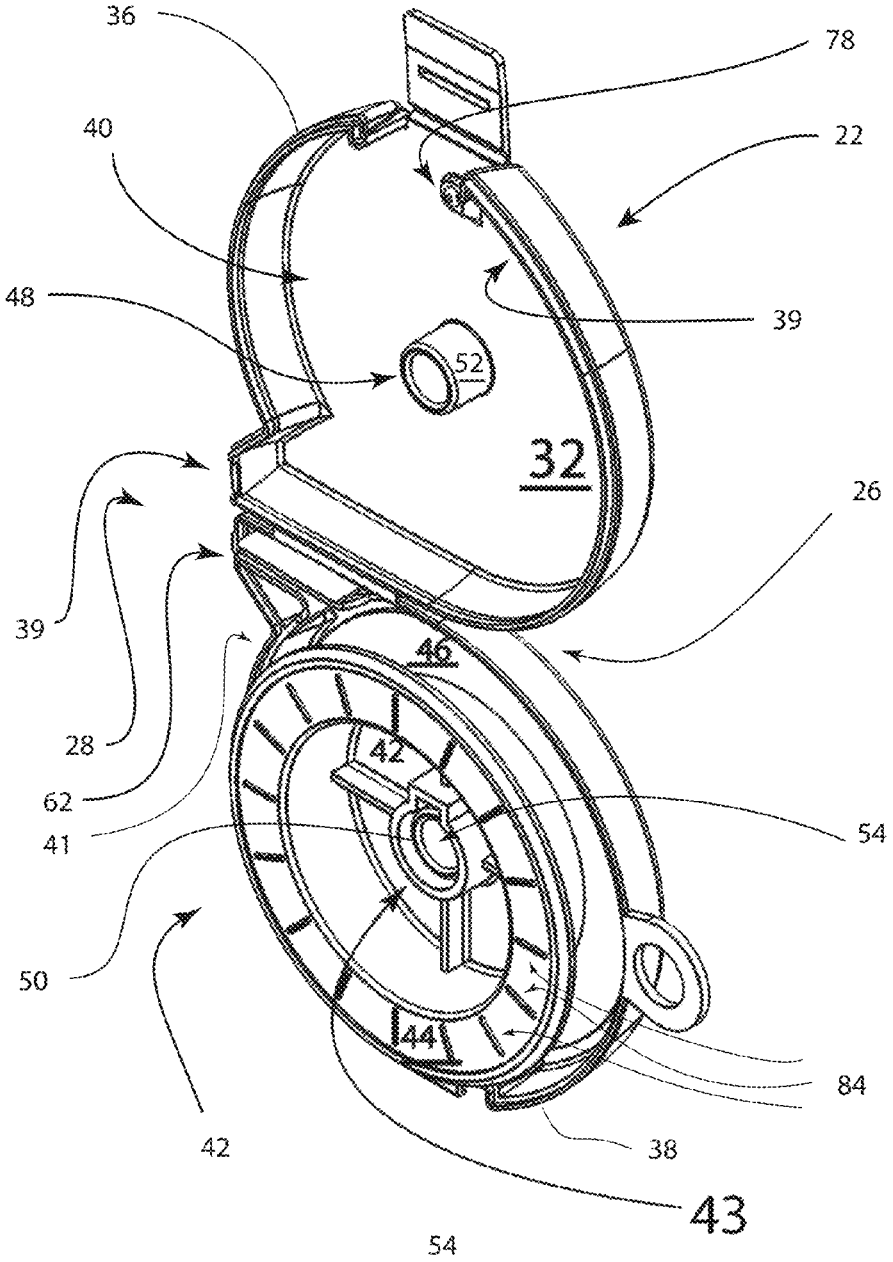
FIG. 8 is an isometric perspective of an alternative embodiment of a dispenser of the present invention whilst
Figure 8A:
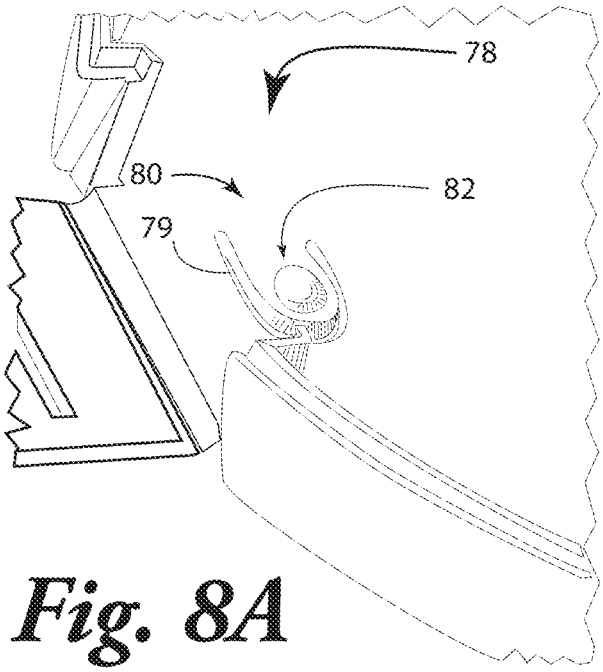
FIG. 8A is a detail illustrating the a reel brake used for counteracting free spin and FIG. 9 illustrates an embodiment having an offset in the throat to frictionally engage wire passing from the dispenser, FIG. 10 uses a gripper pad to retard passage of the wire.
Figure 9:
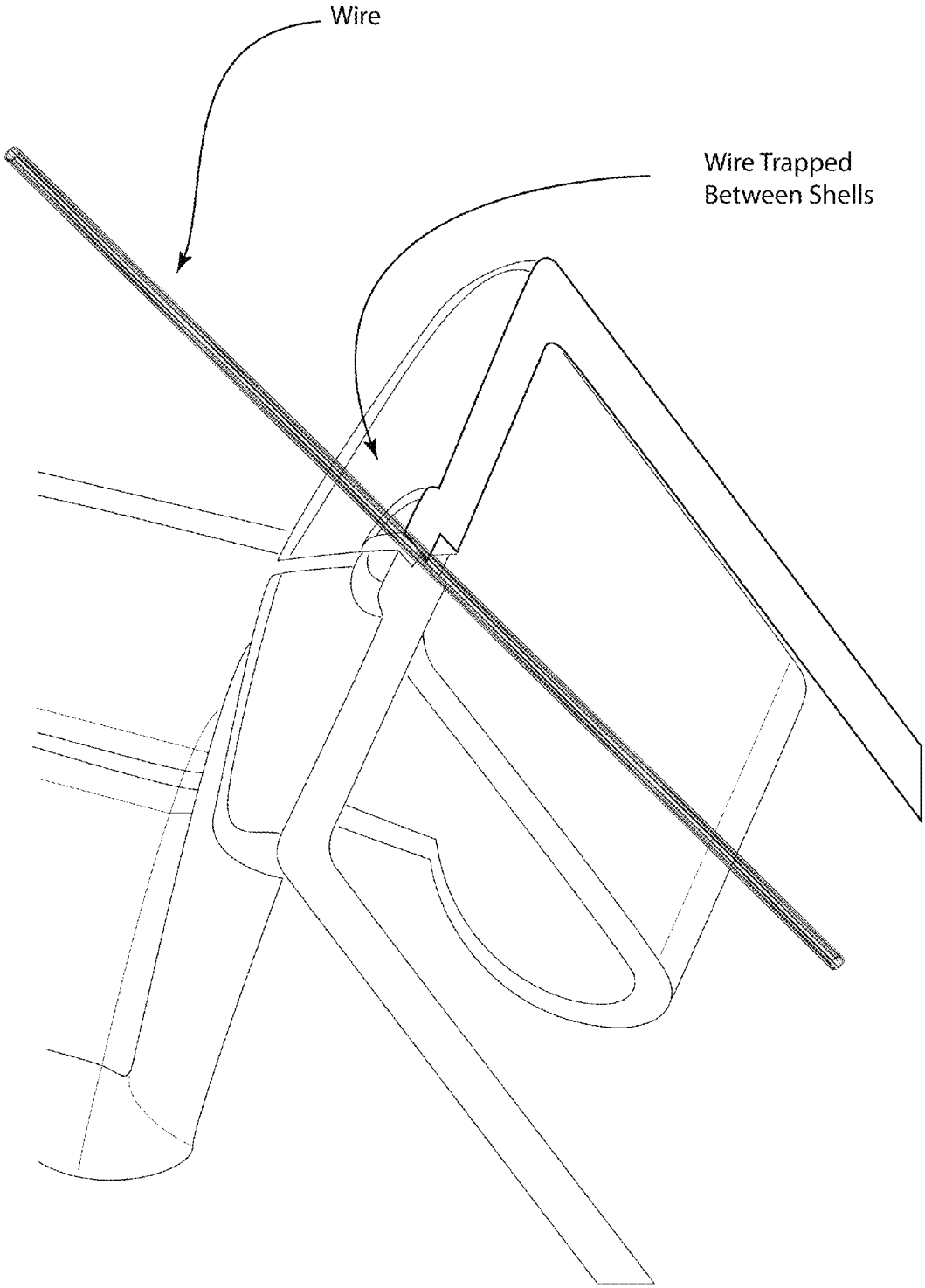

The invention is described in detail below with reference to several embodiments. Such discussion is for purposes of illustration only. Modifications to examples within the spirit and scope of the present invention, set forth in the appended claims, will be readily apparent to one of skill in the art. Terminology used throughout the specification and claims herein is given its ordinary meaning.

In the embodiment shown in FIGS. 1-7, wire dispenser 20 comprises integrally formed housing halves 22 and 24 adjoining each other along first living hinge 26 formed adjacent triangular snout portions 28 and 30 of each housing half 22 and 24 respectively. Housing halves 22 and 24 comprise generally circular planar central portions 32 and 34 adjoining triangular snout portions 28 and 30, with peripheral wall 36 and 38 formed thereabout, respectively. Preferably peripheral walls 36 and 38 are mateable with each other in overlapping engagement between lip 39 and ledge 41 thereby defining generally cylindrical containment cavity 40 with reel 42 disposed therein with reel 42 having hub 43 and flanges 44 and 46 formed thereupon. Axles 48 and 50 are defined by interior wall portions 52 and 54 arising from generally circular planar central portion 32 and 34 respectively. Hub 43 of reel 42 encompasses axles 48 and 50 and maintains reel 42 in position within generally cylindrical containment cavity 40. In the closed conformation, outwardly projecting resilient gripper pads 56 and 57 on peripheral walls 36 and 38 are formed integrally with housing halves 22 and 24 respectively and serve to controllably restrain wire W and prevent it from withdrawing into dispenser 20 while flexible restraining membrane 64 adds a modulated restraining force to wire W.

Figure 12:
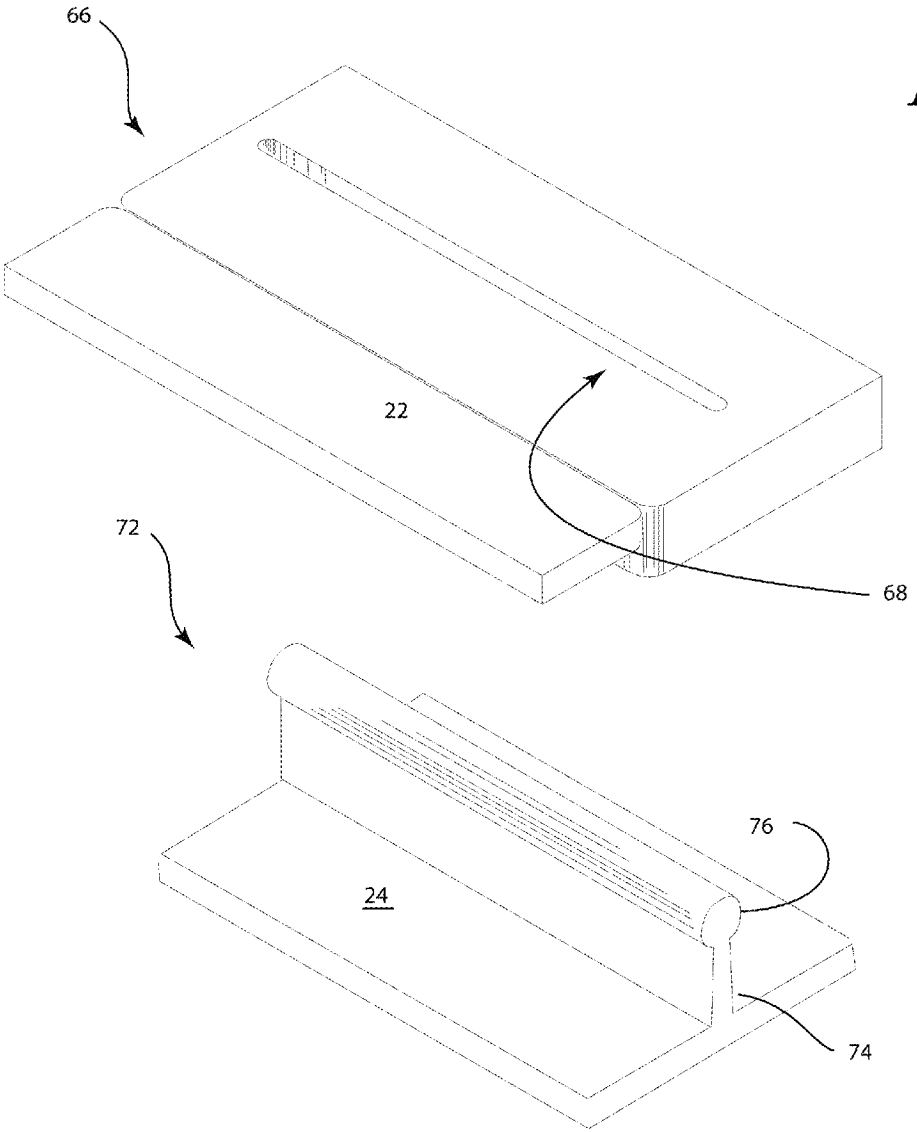
FIG. 12 is a detail view which illustrates details of the clasp retaining the dispenser in a closed configuration.

Retention flap 66 having retention slot 68 formed therein adjoins housing half 22 along second living hinge 70. Retention lug 72 projecting from housing half 24 has prismatic base 74 adjoining housing half 24 while bulbous end portion 76 is spaced distally therefrom. Reel brakes 78 are defined by U-shaped slots 79 formed into generally circular planar portions 32 and 34 forming a tongue shaped flap 80 bearing against inwardly projecting retarding projections 82 which frictionally engage flanges 44 and 46. Retarding projections 82 of reel brakes 78 project upwardly from generally circular planar portion 32 of housing half 22 and bear against flanges 44 and 46 of reel 42 to prevent free-wheeling thereof but are free to retract slightly as each of retarding ridges 84 engage retarding projections 82 seriatim as reel 42 rotates with dispenser 20 while wire W is withdrawn therefrom. When housing halves 22 and 24 are urged against each other and peripheral walls 36 and 38 are overlappingly engaged as described above, dispenser 20 may be locked into the closed configuration with retention lug 72 passing through retention slot 68 in retention flap 66 as shown in FIG. 12. In the closed conformation, resilient gripping pads 56 and 57 engage wire W preventing it from withdrawing into dispenser 20 while contributing to the force required to withdraw wire W from the dispenser.

The embodiment of FIGS. 8-11 illustrates an alternative gripping mechanism in which walls 58 and 60 are formed integrally with housing half 24 and define longitudinal channel or slot 62 through which wire W passes. Longitudinal channel or slot 62 is sized such that it takes advantage of the natural curvature in wire W resulting from its previous condition of being wound around hub 43 of reel 42, as this curvature urges wire W against transverse walls 58 and 60 in housing half 24 and serves to frictionally retard its motion in or out of dispenser 20. After wire W passes through longitudinal channel or slot 62 and thence between projecting pressing pad 57 formed integrally with housing half 22 and projecting pressing pad 56 formed integrally with housing half 24, wire W exits dispenser 20 and may be snipped off at any convenient length by the user. Throughout this specification, similar parts in alternative embodiments will bear either the same number as the corresponding part in the first embodiment or the same number except increased by a multiple of 100 depending upon the similarity of function. Thus living hinges 126 and 226 in FIGS. 13, 14, and 15 correspond to living hinge 26 in FIGS. 1, 3, 5 and 6 while reels 142 and 242 similarly correspond to reel 42 in FIGS. 1, 3, 5 and 6.

Figure 10:
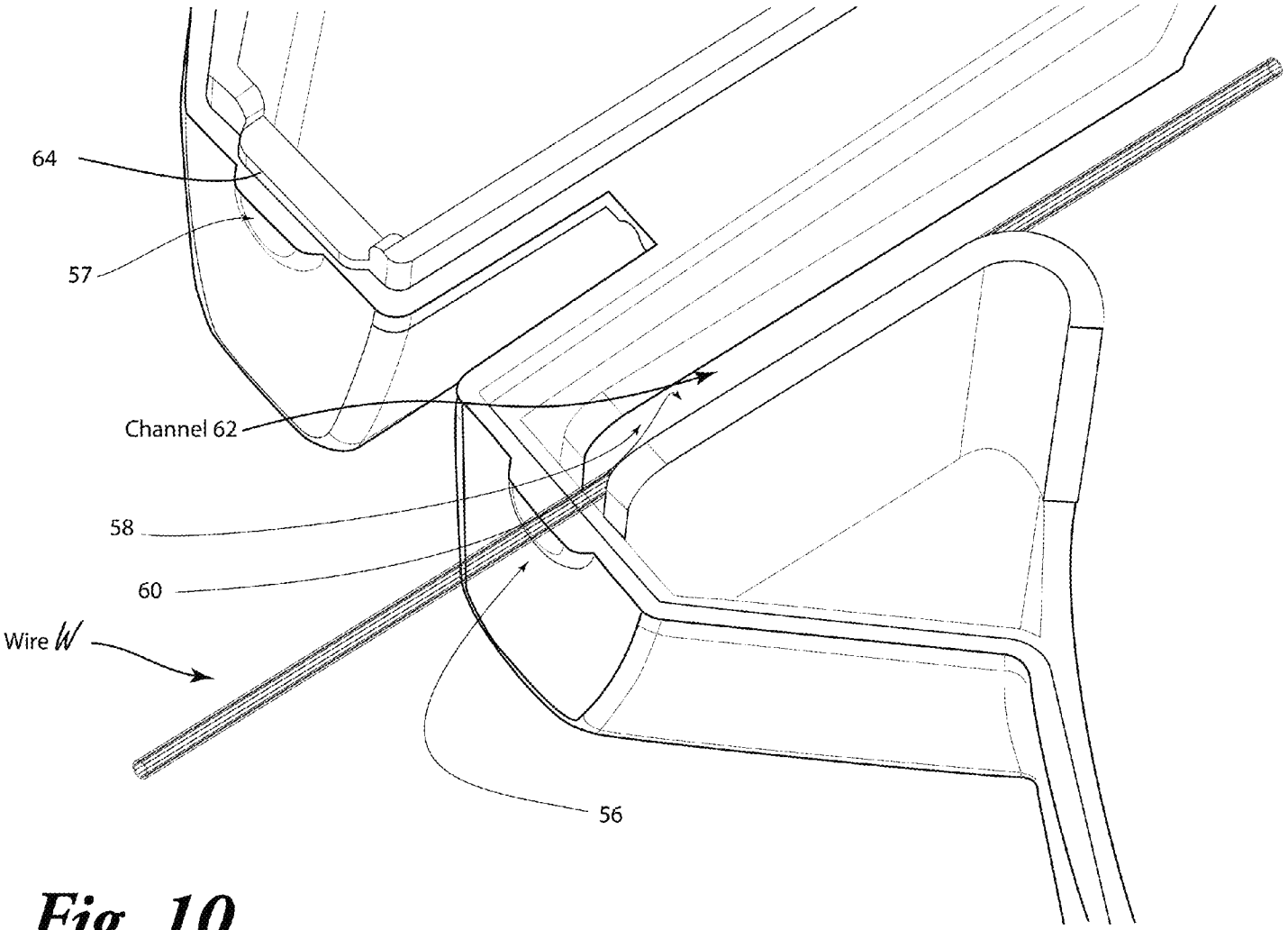
FIG. 10A illustrates an embodiment using a restraining membrane to retard passage of the wire.
Figure 10A:
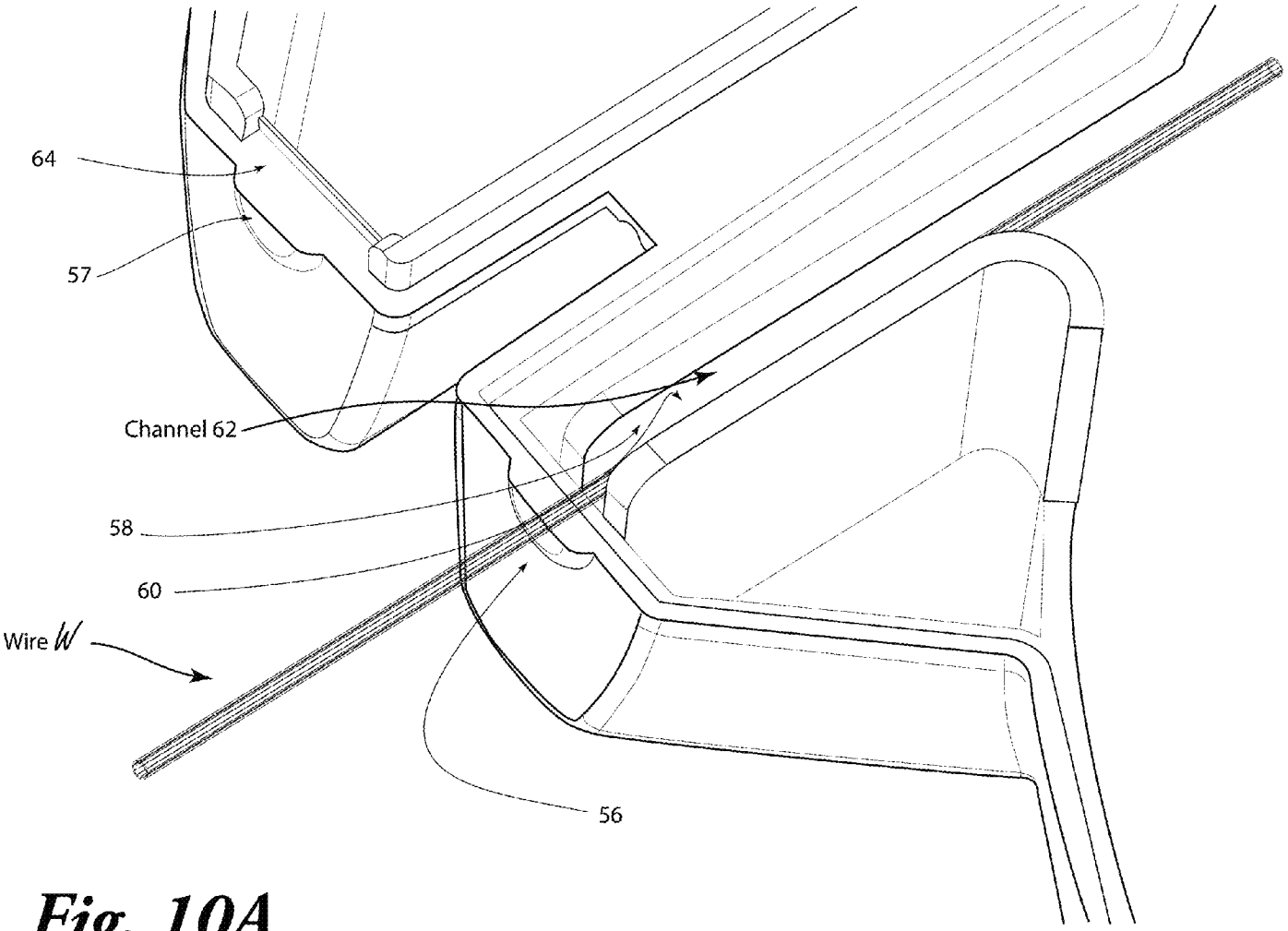
Figure 11:
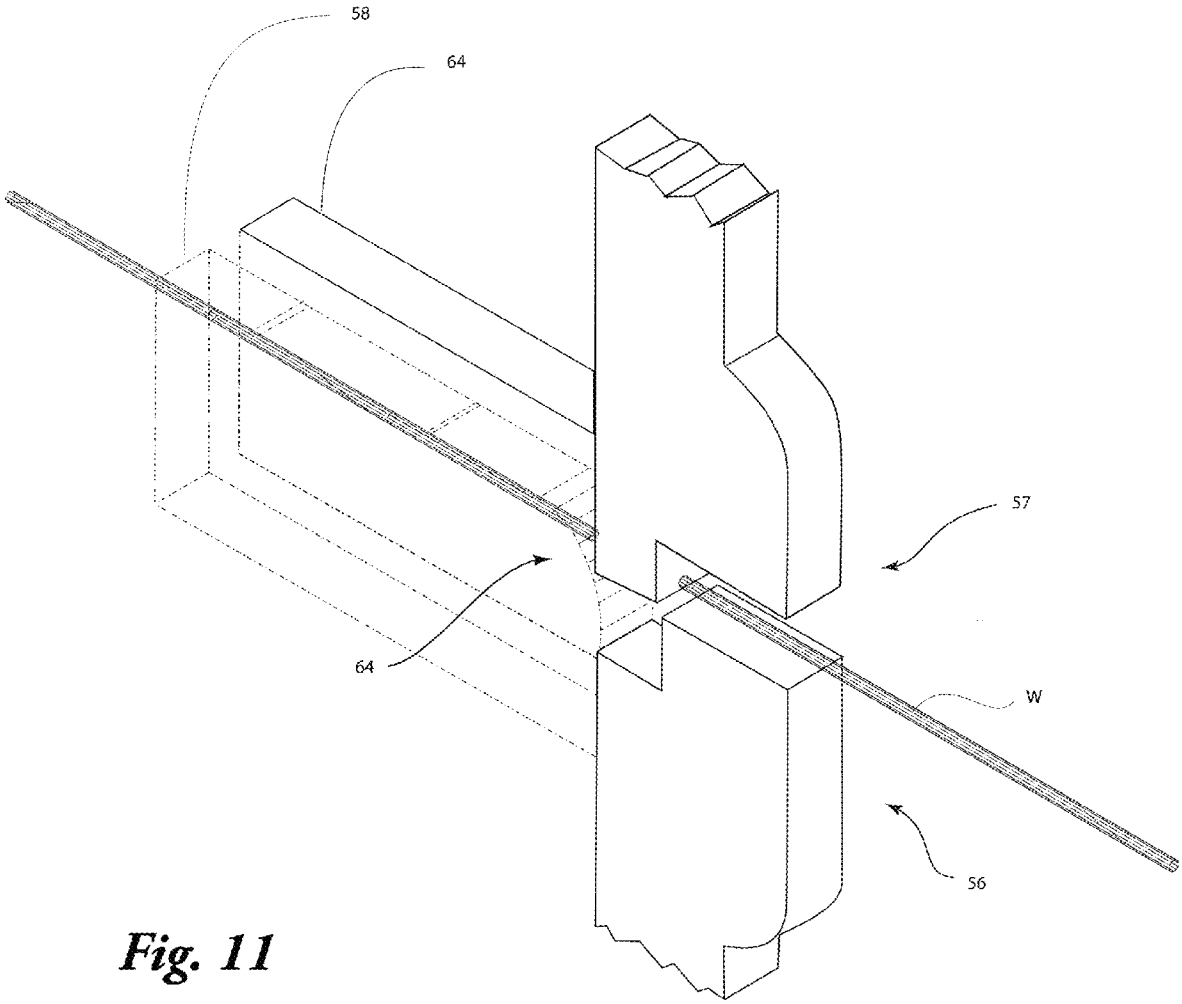
FIG. 11 is a fragmentary view illustrating only those portions of the dispenser interacting with the wire as it exits the dispenser.
Figures 13, 14, 15:
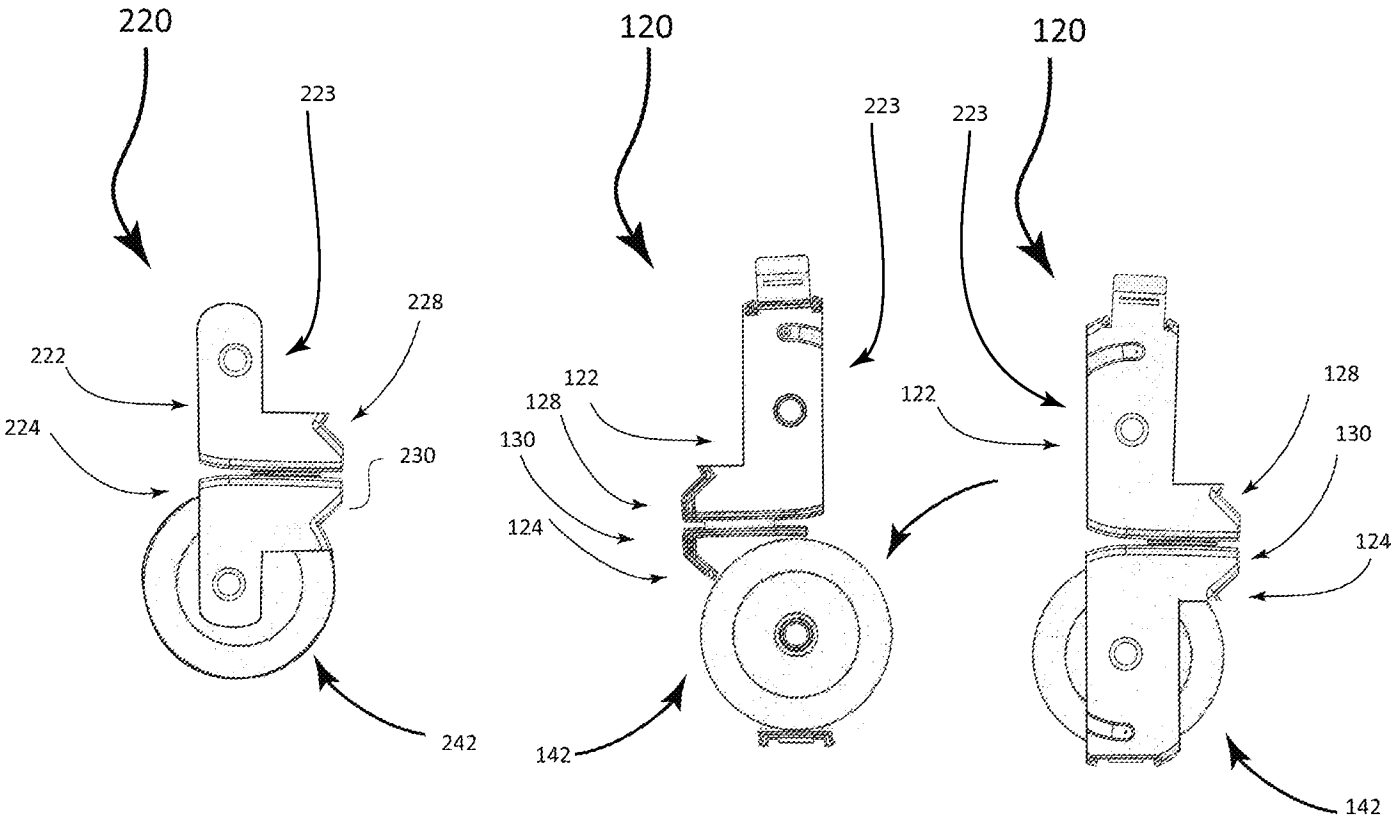
FIG. 13 is an interior plan view of the material saving dispenser of the present invention.
FIG. 14 is an exterior plan view of the material saving dispenser of the present invention.
FIG. 15 is an exterior plan view of an alternative dispenser of the present invention in which material requirement is even further reduced.

In the alternative embodiment of FIGS. 8, 9, 10, 10A and 11, parts performing the same function are numbered similarly as the principal differences are in their relative dispositions rather than the functions. Thus pressing pad 57 bears against wire W from below while projecting pressing pad 56 bears against wire W from above but pressing pad 57 and membrane 64 serve to restrain wire W frictionally as wire W is trapped between them but must also pass through restraining membrane 64 which both yields flexibly in the direction perpendicular to wire W's travel and may deform more permanently to form a groove (not shown) accommodating wire W, while wire W is both laterally restrained between transverse walls 58 and 60 as well as being frictionally restrained as discussed above. In view of the slight but finite stiffness of wire W, and the slight curvature therein resulting from wire W being unreeled from reel 42, both outward and inward movements of wire W are restrained by this arrangement in which wire passes between two transverse walls 58 and 60 which are spaced apart by a distance which is greater than the diameter of wire W but less than the curvature resulting in wire W over the length of transverse walls 58 and 60 resulting from its stay on reel 42 while pressing pads 57 and 56 frictionally engage wire W so that when wire W is snipped outwardly of projecting pressing pads 56 and 57 by external means (not shown) such as a wire cutter, wire W neither retreats into cylindrical containment cavity 40 nor does it spontaneously unspool outwardly without being urged in that direction by an appreciable external force. Even if pushed inwardly, the slight spacing between pressing pads 57 and 56 will often make it possible to retrieve a free end with a finger nail or tweezers without separating the housing halves 22 and 24 from each other. In the closed configuration, gripping pads 57 and 56 are urged against wire W passing from the interior of wire dispenser 20 through slot 62 and between gripping pads 57 and 56 to the exterior of dispenser 20 thereby forestalling undesired retraction of wire W into the interior of wire dispenser 20 in use. In use, grooves (not shown) may be worn into either or both of pads 57 and 56 as well as into flexible restraining membrane 64 as wire W is withdrawn. Alternatively, such a groove may be intentionally formed but preferably is not of sufficient size that wire W passes freely therethrough. In FIG. 10A, flexible restraining membrane 64 is depicted as having a thickness of at least about 2 mils, preferably at least about 3 mils and more usually between about 3 mils to 100 mils, preferably between about 8 and 75 mils, more preferably between about 9 and 50 mils, and most preferably between about 10 and 35 mils, allowing membrane 64 to deform easily and flexibly to accommodate wires W of various thicknesses easily, making dispenser 20 well suited to accommodate wires of any of the diameters commonly used for beading. In contrast, in FIG. 10, restraining membrane 64 is depicted as considerably thicker so the degree of flexible deformation will be decreased and the degree of permanent deformation such as would result from wearing of a groove therein is greater In the embodiment shown in FIGS. 13-15, much of the structure is the same and functions similarly as in the previous embodiments in FIGS. 1-12 and thus need not be described in detail. In FIGS. 13 and 14, wire dispenser 120 comprises integrally formed housing halves 122 and 124 adjoining each other along first living hinge 126 formed adjacent triangular snout portions 128 and 130 of each housing half 122 and 124 respectively. Housing halves 122 and 124 comprise triangular snout portions 128 and 130. In FIG. 15, wire dispenser 220 comprises integrally formed housing halves 222 and 224 adjoining each other along first living hinge 226 formed adjacent triangular snout portions 228 and 230 of each housing half 222 and 224 respectively. Housing halves 222 and 224 comprise triangular snout portions 228 and 230. The embodiments of FIGS. 13-15 are best conceptualized as functioning in the same fashion as the embodiments of FIGS. 1-12 with those parts of the housing which are not essential to functioning of the dispenser being cut away to save material forming dispensing arm integrally formed from polymeric material 223 and allow for use of smaller molds resulting in improved manufacturing efficiency.

In the embodiment shown in FIGS. 13-15, much of the structure is the same and functions similarly as in the previous embodiments in FIGS. 1-12 and thus need not be described in detail. In FIGS. 13 and 14, wire dispenser 120 comprises integrally formed housing halves 122 and 124 adjoining each other along first living hinge 126 formed adjacent triangular snout portions 128 and 130 of each housing half 122 and 124 respectively. Housing halves 122 and 124 comprise triangular snout portions 128 and 130. In FIG. 15, wire dispenser 220 comprises integrally formed housing halves 222 and 224 adjoining each other along first living hinge 226 formed adjacent triangular snout portions 228 and 230 of each housing half 222 and 224 respectively. Housing halves 222 and 224 comprise triangular snout portions 228 and 230. The embodiments of FIGS. 13-15 are best conceptualized as functioning in the same fashion as the embodiments of FIGS. 1-12 with those parts of the housing which are not essential to functioning of the dispenser being cut away to save material thereby defining dispensing arm integrally formed from polymeric material 223 and allow for use of smaller molds resulting in improved manufacturing efficiency.

Preferably, a polymeric beading wire guide is provided having an axis about which the reel is rotable and an integrally formed polymeric arm 310 extending from the axis of said hub to a location exterior to said flanges, wherein the reel braking force and the beading wire restraining force are exerted by the arm.

In a preferred embodiment of the method of manually dispensing beading wire by a user, the method comprises the steps of: providing a reel, manually graspable by a user and adapted to be held in the user's palm, having: a hub having an axis of rotation and a pair of spaced apart flanges defining an annular wire storage region between said flanges and exterior to said hub, said reel being rotable around the axis of rotation of said hub; a length of beading wire wrapped around said hub, and disposed between said flanges; wherein when the reel is held in the user's palm, the beading wire is being manually withdrawn by said user and a grip is provided for grasping the beading wire and exerting a beading wire restraining force on the wire to prevent unreeling from around said reel without rotation of said reel around said axis; and a brake is provided for exerting a reel braking force acting upon at least one of the flanges to hinder free rotation of said reel.

Preferably, the reel braking force and the beading wire restraining force are exerted by a polymeric arm 310 extending from the axis of said hub to a location exterior to said flanges. In preferred embodiments, the mass of polymer included in said arm 310 is less than 10 grams; and the arm 310 is integrally formed from polymeric material.

In a more preferred embodiment, the method comprises the steps of: providing a reel having: a hub having an axis of rotation and a pair of spaced apart flanges defining an annular wire storage region between said flanges and exterior to said hub, said reel being rotable around the axis of rotation of said hub; wherein the reel has a length of beading wire wrapped around the hub and disposed between the flanges; and a dispensing arm 310 integrally formed from polymeric material, extends from the hub of said reel to a location exterior to the flanges, the mass of polymer included in the arm 310 being less than 10 grams and the dispensing arm 310 has: a gripper formed therein for grasping the beading wire and exerting a beading wire restraining force on the beading wire to prevent unreeling from around said reel without rotation of the reel around said axis; and a pressing foot for pressing against at least one of the flanges and exerting a reel braking force acting thereupon to hinder free rotation of said reel, and the reel is held, and the beading wire being manually pulled, by said user. Wires usable with the method include beading wire having a plurality of at least 7 strands up to 49 strands and ranging in diameter from between 0.007" and 0.024" wherein the number of strands in the beading wire is either 19 or an integral multiple of 7 with the strands being embedded in a cylindrical polymeric matrix, preferably comprising a polyamide such as nylon. More preferably, the beading wire comprises 7, 19, or 21 strands. In the case where the beading wire comprises 21 or 49 strands, the strands are arrayed in circular groups of 7 strands combined to form the finished beading wire.

A particularly desirable feature of the present invention lies in the controlled force required for dispensing wire. Preferably, the force required to withdraw wire from the dispenser varies with the wire diameter in accordance with the following Table 1.

TABLE 1

| Withdrawal Force | | | | | |
|---|---|---|---|---|---|
| Wire diameter (in.) | Minimum Extend force (g) | Preferred Extend force (g) | More Preferred Extend Force (g) | Most Preferred Extend Force (g) | Maximum Extend force (g) |
| 0.024 | 20 | 25-1000 | 25-500 | 40-400 | 1500 |
| 0.018 | 15 | 15-750 | 25-400 | 40-350 | 1200 |
| 0.015 | 10 | 15-500 | 25-300 | 30-300 | 1000 |
| 0.012 | 5 | 10-500 | 15-250 | 20-200 | 1000 |

Figure 17:
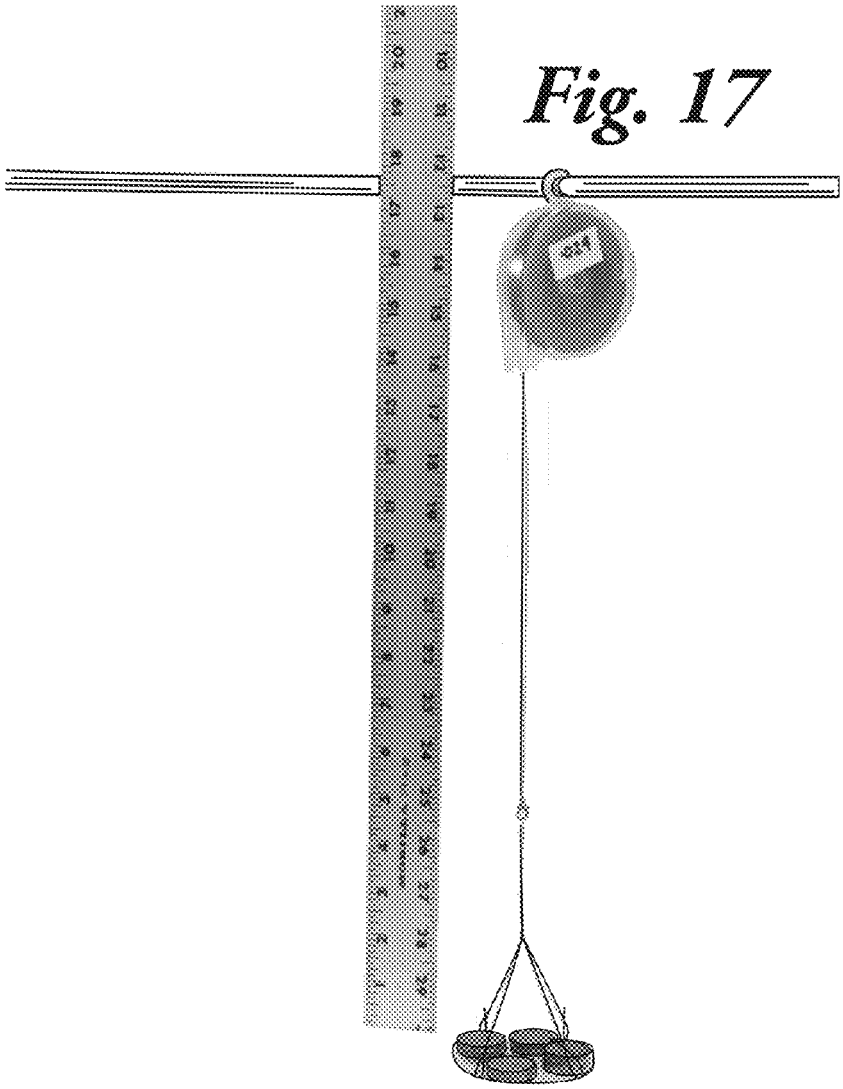
FIGS. 17 and 18 schematically illustrate a simple experiment to estimate the force required to withdraw wire from the dispenser.
Figure 18:
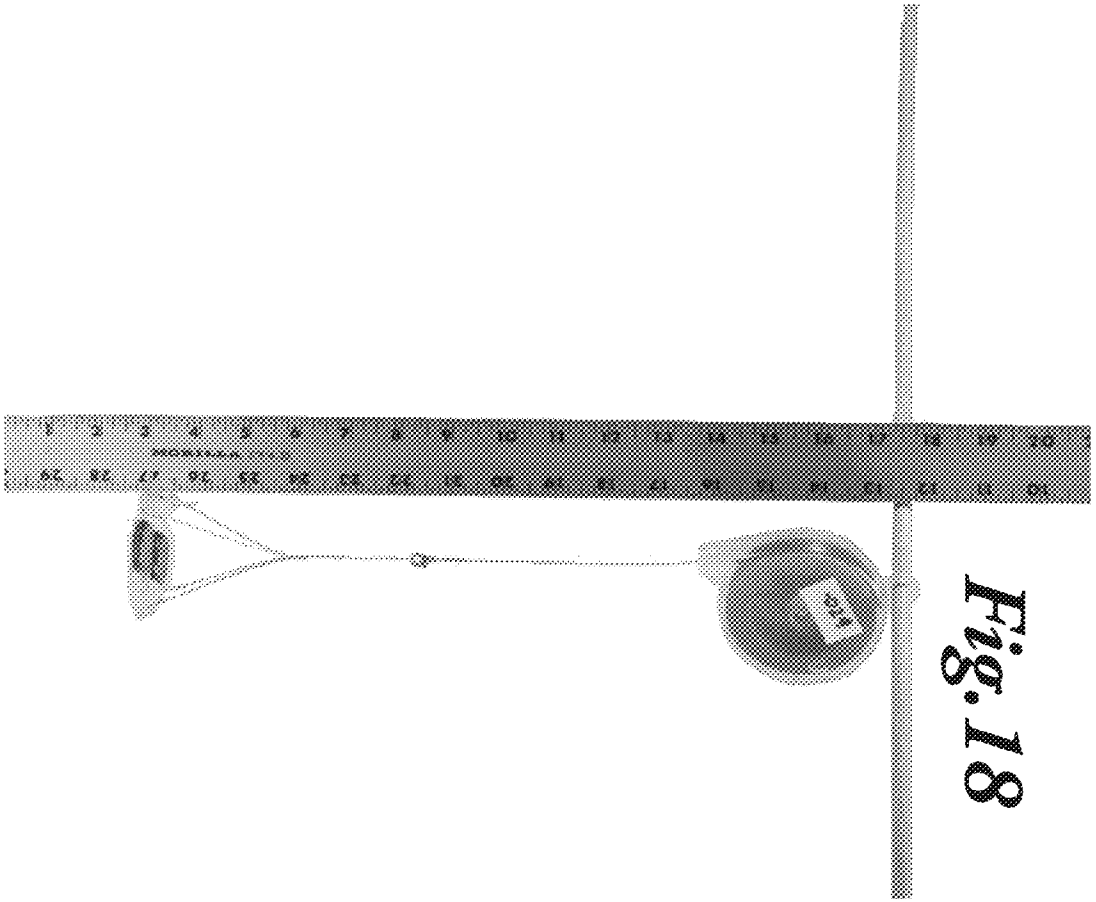

In preferred embodiments, the dispenser will be formed from polypropylene and the transverse distance between the walls of said longitudinal channel is between about 1/32" and 3/32" preferably about 1/16", with the length of the longitudinal channel being between about 1/2" to about 1". Experiments were conducted using a polypropylene dispenser 20 hung from a support 311 with a small tray 312 attached to the end of the wire. Weight was successively added to the tray 311 to determine the weight that the wire was capable of sustaining (retain force) and the weight required to withdraw wire W from the dispenser 20 (extend force) as illustrated in FIGS. 17 and 18. In the case of a polypropylene dispenser 20 having a channel with a length of about 1/2" and a transverse distance of about 1/16" between said walls it was found that, for each diameter of beading wire W investigated, the force required to extend the wire from within the dispenser 20 was generally between the retain force and the extend force indicated below in Table 2.

TABLE 2

| Wire diameter (") | Retain force (g) | Extend force (g) |
|---|---|---|
| 0.024 | 85 | 91 |
| 0.018 | 68 | 74 |
| 0.015 | 51 | 57 |
| 0.012 | 40 | 45 |

Accordingly, it can be appreciated that, in a dispenser configured as suggested, only a moderate but easily sustainable force is required to withdraw wire from the dispenser but the wire will not unwind unless some force is applied to the free end. Thus the wire remains neatly in place in the dispenser unless the user wishes to withdraw wire but only a moderate force is required to withdraw as much wire is required.

In a still more preferred embodiment, the method of manually dispensing beading wire by a user, comprises the steps of: providing a reel having: a hub having an axis of rotation and a pair of spaced apart flanges defining an annular wire storage region between said flanges and exterior to said hub, said reel being rotable around the axis of rotation of said hub; a length of beading wire wrapped around said hub and disposed between said flanges, said beading wire having a diameter between 0.007" and 0.024" and comprising a multiplicity of at least 19 strands or 7 strands or an integral multiple of seven strands embedded in a polyamide matrix; providing a dispensing arm 310 integrally formed from polymeric material, extending from the hub of said reel to a location exterior to said flanges, the mass of polymer included in said arm 310 being less than 10 grams, said dispensing arm 310 having: a gripper formed therein for grasping said beading wire and exerting a beading wire restraining force on said beading wire to prevent unreeling from around said reel without rotation of said reel around said axis; and a pressing foot for pressing against at least one of said flanges and exerting a reel braking force acting thereupon to hinder free rotation of said reel, said reel being held, and said beading wire being manually pulled, by said user.

In manufacture, dispenser 20 can be formed from any convenient polymer or even metal if it is acceptable to substitute a true hinge for the living hinge; but dispenser 20 will normally be formed from a polymer capable of forming a living hinge of rather extended duration, typically polypropylene or polyethylene although engineering resins like nylons or acetals can be substituted if shorter life span is acceptable. The mechanical dimensions suitable for living hinges are well known.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A dispenser for flexible beading wire comprising:

an integrally formed housing;

a resilient gripping member; and a reel having a length of beading wire coiled therearound;

said length of beading wire extending exteriorly from said dispenser said integrally formed housing comprising two mating housing halves joined by a first living hinge, said housing halves being configurable in an open configuration and in a closed configuration, each said housing half having a generally planar central portion and a snout portion adjacent thereto, said generally planar central portion and said snout portion being generally encompassed by an upstanding peripheral wall overlappingly engageable with the peripheral wall on the adjoining housing half, said housing halves in said closed configuration defining a generally cylindrical reel containment cavity having a centrally located axle located therein;

the snout portion having a retention portion formed therein, the retention portion having opposed walls defining a longitudinal channel and a transverse channel formed therein, said longitudinal channel being generally parallel to a tangent to the cylindrical reel containment cavity, said transverse channel being generally transverse to the longitudinal channel and being adapted to retain said resilient gripping member therein, said beading wire bearing against said walls of said longitudinal channel;

wherein:

at least one of said housing halves has a reel brake formed into the generally planar portion thereof;

at least one of said housing halves has a locking flap formed therein at a location generally opposed to the location of said first living hinge, said locking flap being joined to the generally planar portion of the housing half by a second living hinge, the other of said housing halves having a locking lug formed therein, said locking flap being engageable with said locking lug to maintain said housing halves in said closed configuration;

said reel is rotably mounted within said cylindrical reel containment cavity continuously engaging said reel brake; and said beading wire passes from said reel, through said snout and engages said resilient gripping member and frictionally engages both said opposed walls of said longitudinal channel as it extends exteriorly to said dispenser.

2. A dispenser for flexible beading wire comprising:

an integrally formed housing having a reel brake integrally formed therein; and a reel having a length of beading wire coiled therearound and extending exteriorly from said dispenser;

said integrally formed housing comprising two housing halves, said housing halves configurable into a closed configuration;

each said housing half having a central portion acrd a snout portion adjacent thereto;

said housing halves in said closed configuration defining said dispenser having a reel containment cavity defined therein; and a centrally located axle located therein;

the snout portion having a retention portion formed therein, the retention portion having a longitudinal channel having opposed wall portions formed therein, said longitudinal channel being generally parallel to a tangent to the reel, each of said wall opposed portions of said channel being adapted to engage a portion of said beading wire extending exteriorly to said housing; and wherein said reel is rotably mounted within said reel containment cavity continuously bearing against said reel brake, and said beading wire passes from said reel, through said longitudinal channel, and bears against both said opposed wall portions of said transverse longitudinal channel as it extends exteriorly to said dispenser.

3. The dispenser of claim 2, wherein: said reel has at least one flange thereupon, and a reel brake is formed into at least one of said housing halves, wherein said reel brake comprises a flexible flap surrounded by a slot formed into said central portion of said housing half, said flexible flap bearing a retarding projection extending inwardly interiorly into said reel containment cavity bearing against said flange of said reel and serving to retard rotation of said reel.

4. The dispenser of claim 3, wherein said slot defining said reel brake is U-shaped.

5. The dispenser of claim 3, wherein the slot defining said reel brake has arcuate legs.

6. The dispenser of claim 2, wherein a reel brake is formed into at least one of said housing halves and the reel brake comprises an interiorly extending dome-shaped projection formed into the central portion of one of said housing halves.

7. The dispenser of claim 6, wherein the reel comprises at least two flanges and said dispenser comprises two reel brakes, each reel brake bearing against one of said flanges.

8. The dispenser of claim 2 wherein integrally formed restraining membrane is formed into one of said halves adjacent the longitudinal channel bearing against said beading wire as it exits the dispenser.

9. The dispenser of claim 8, wherein said central portion of each said half is generally circular, said snout portion is generally triangular and adjoins said central portion along its longest leg, each said central portion having upstanding sidewalk overlappingly engageable with the upstanding sidewalk of the other central portion, and said restraining membrane has a thickness of between about 5 and 100 mils and is urged against said beading wire when said housing halves are in their closed configuration.

10. A dispenser for flexible beading wire comprising:

(a) an integrally formed housing;

(b) a reel having a length of beading wire coiled therearound and extending exteriorly from said dispenser;

said integrally formed housing comprising two engageable housing halves, said housing halves being configurable in an open configuration and in a closed configuration, each said housing half having a generally planar central portion and a snout portion, said generally planar central portion and said snout portion being generally encompassed by an upstanding peripheral wall overlappingly engageable with the peripheral wall of the opposing housing half; said housing halves in said closed configuration defining a generally cylindrical reel containment cavity;

(c) a retention portion formed adjacent said snout portion the retention portion comprising opposed walls defining a longitudinal channel, said longitudinal channel being generally parallel to a tangent to the cylindrical reel containment cavity, each opposed wall of said channel being adapted to engage a portion of said beading wire extending exteriorly to said housing; and (d) a reel brake formed into said housing continuously bearing against said reel and retarding rotation thereof; wherein:

said reel is notable within said cylindrical reel containment cavity and said beading wire passes from said reel through said longitudinal channel engaging said opposed walls of said longitudinal channel as it extends exteriorly to said housing.

11. The dispenser of claim 10, wherein:

said reel has at least one flange thereupon; and said reel brake is formed into the generally planar central portion of at least one of said housing halves, said reel brake comprising a flexible tongue surrounded by a slot formed into said central portion of said housing half, said flexible tongue bearing a retarding projection extending inwardly into said reel containment cavity continuously bearing against said flange of said reel and serving to retard rotation of said reel.

12. The dispenser of claim 11, wherein said slot defining said reel brake is U-shaped.

13. The dispenser of claim 12, wherein the slot defining said reel brake has arcuate legs.

14. The dispenser of claim 11, wherein said reel brake further comprises an interiorly extending dome-shaped projection formed into the central portion of one of said housing halves.

15. The dispenser of claim 10, further comprising a restraining membrane integrally formed with said dispenser adjacent to said longitudinal channel and bearing against said beading wire as it passes through said channel to the exterior of said dispenser.

16. The dispenser of claim 15, wherein said snout has a pair of pressing pads integrally formed therewith adjacent the upstanding peripheral walls in the snout portion of said dispenser and bearing against said heading wire as it passes without said dispenser.

17. The dispenser of claim 16 wherein said restraining membrane has a thickness of between 5 and 100 mils.

18. The dispenser of claim 17, wherein said housing halves are joined by a living hinge, at least one of said housing halves has a locking flap formed therein at a location generally opposed to the location of said living hinge, said locking flap is joined to the generally planar portion of the housing half by a second living hinge, the other of said housing halves having a locking lug formed therein, said locking flap being engageable with said locking lug to maintain said housing halves in said closed configuration; and said central portion of each said housing half is generally circular, said snout portion is generally triangular and adjoins said central portion along its longest leg, said upstanding sidewalls engage overlappingly, said locking flap has a slot defined therein extending generally tangentially to the periphery of said generally circular central portion of its associated housing half, the locking lug has:

a base adjoining its associated housing half and extending tangentially to the periphery of the generally circular central portion of its associated housing half; and a bulbous portion formed distal to said associated housing half, said bulbous portion being insertable through the slot defined in the locking flap when said housing halves are in their closed configuration.

19. A dispenser for flexible beading wire comprising:

an integrally formed housing; and a reel having a length of beading wire coiled therearound; said length of beading wire being extendable exteriorly from said dispenser;

said integrally formed housing comprising two mating housing halves joined by a first living hinge, said housing halves being configurable in an open configuration and in a closed configuration, each said housing half having a generally planar central portion and a snout portion adjacent thereto, said generally planar central portion and said snout portion being generally encompassed by an upstanding peripheral wall overlappingly engageable with the peripheral wall on the adjoining housing half, said housing halves in said closed configuration defining a generally cylindrical reel containment cavity having a centrally located axle located therein;

the snout portion having a retention portion formed therein, the retention portion having a longitudinal channel and a resilient gripping membrane formed integrally with said housing, said longitudinal channel being generally parallel to a tangent to the cylindrical reel containment cavity, wherein:

at least one of said housing halves has a reel brake formed into the generally planar portion thereof continuously bearing against said reel;

wherein said resilient gripping membrane is located between said longitudinal channel and the exterior of said dispenser and hears against said beading wire as it exits said dispenser;

said reel is rotably mounted within said cylindrical reel containment cavity; and said beading wire may be passed from said reel, through said longitudinal channel and deformably engage said resilient gripping membrane as it is withdrawn exteriorly to said dispenser.

* * * * *